United States Patent [19]

Turner

[11] Patent Number: 4,842,281

[45] Date of Patent: Jun. 27, 1989

[54] OPTION BOARD GAME

[76] Inventor: Gerald Turner, Rt. 2, 116 Fantasy Dr., Lyles, Tenn. 37098

[21] Appl. No.: 149,365

[22] Filed: Jan. 28, 1988

[51] Int. Cl.[4] ..... A63F 3/00

[52] U.S. Cl. ..... 273/256; 273/272; 273/DIG. 26

[58] Field of Search ..... 273/272, 256, 243, 249, 273/276, 274

[56] References Cited

U.S. PATENT DOCUMENTS

| | | | |
|---|---|---|---|
| 2,064,229 | 12/1936 | Spiro | 273/243 |
| 2,602,667 | 7/1952 | Poarch | 273/243 |
| 3,468,540 | 9/1969 | Mulligan | 273/256 |
| 3,889,954 | 6/1975 | Malisow | 273/256 |
| 3,951,411 | 4/1976 | Hill et al. | 273/243 |
| 4,061,337 | 12/1977 | Callender | 273/243 |
| 4,252,320 | 2/1981 | Rouse | 273/243 |
| 4,279,422 | 7/1981 | Shaw | 273/243 |
| 4,306,724 | 12/1981 | Brzezinski et al. | 273/243 |
| 4,415,160 | 11/1983 | Lamb | 273/243 |
| 4,484,748 | 11/1984 | Becze | 273/256 |

*Primary Examiner*—Richard C. Pinkham
*Assistant Examiner*—Benjamin Layno
*Attorney, Agent, or Firm*—Jerry T. Kearns

[57] ABSTRACT

A board game utilizes a rectangular game board having a peripheral path of movement formed by a series of squares. Intersecting horizontal and vertical movement paths positioned on the interior of the game board connect with the peripheral movement path. Various squares of the movement paths are printed with individual letters of the key phrase "LIFE'S LITTLE PLEASURES" and also with the letters of the word "ZONK". Various squares of the movement paths are designated with monetary rewards or penalties. Certain squares are random chance squares, with the consequence of landing on these squares determined by reference to a random consequence chart. Players move game markers around the game board according to the throw of dice, and attempt to spell the key phrase, before spelling "ZONK" or going bankrupt.

4 Claims, 7 Drawing Sheets

Fig 9
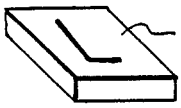
Fig 10
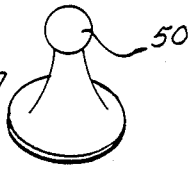
Fig 11
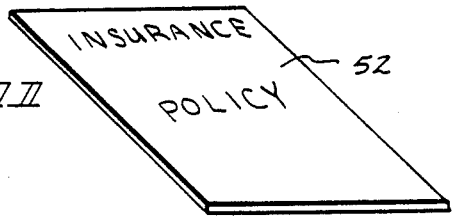
Fig 12
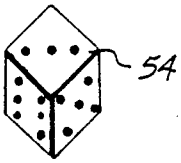
Fig 13
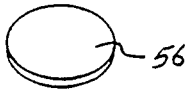
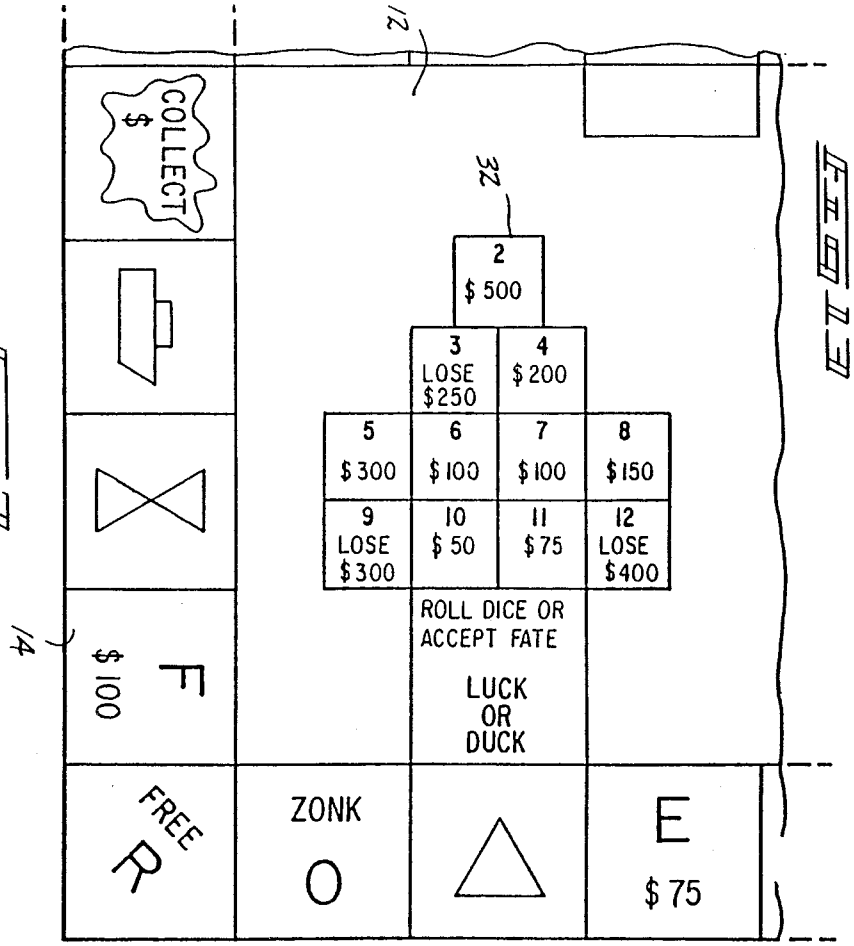
Fig 7

OPTION BOARD GAME

BACKGROUND OF THE INVENTION

1. Field of the Invention

The present invention relates to board games, and more particularly pertains to a new and improved option board game. Various types of board games are available which utilize a game board having a peripheral movement path formed by a series of squares. These conventional board games utilize player pieces whose movement is determined by the throw of dice. The present invention seeks to provide a more interesting and exciting game by adding an element of decision making to the play of the game. Players are required to make financial decisions regarding the purchase of letters required to spell the words of a key phrase, without going bankrupt. Random consequence tables are provided to simulate the random nature of the opportunities and consequences of life.

2. Description of the Prior Art

Various types of board games are known in the prior art. A typical example of such a board game is to be found in U.S. Pat. No. 3,951,411, which issued to C. Hill et al on Apr. 20, 1976. This patent discloses a board game for two or more players simulating the popular conception of espionage. A set of pieces is allotted to each player who must play on an outer part of the board to collect various items used in espionage in order to qualify to play on an inner part of the board. The board is set out in sectors divided symbolically by barriers which can be bridged to move to an opposing player's sector. U.S. Pat. No. 4,061,337, which issued to W. Callender on Dec. 6, 1977, discloses a board game having spaces providing a path of movement for a game piece about the periphery of the board. Movement of the game piece is determined from instruction cards placed face down in separate stacks on the game board. Each stack is covered by a control card visibly depicting a different musical note. The game includes chance cubes having a different character letter thereon which corresponds to a note depicted on one of the control cards. In order to gain access to an instruction card to enable movement of the game piece, a player must compare the character letter on a cube with the notes depicted on the control cards and recognize the depicted note which corresponds to the character letter. Having done so, the player is entitled to remove the underlying instruction card and move the game piece accordingly. The game is designed to provide musical education. U.S. Pat. No. 4,252,320, which issued to G. Rouse on Feb. 24, 1981, discloses a maze board game for play by three players or groups of players. The game utilizes a game board bearing a substantially rectangular maze. The maze is divided into a number of spaces or steps and includes a number of blocking positions. The maze is delineated on three sides by residence strips which have designated residence positions. Play of the game is dictated by the roll of dice. The object of the game is to move a marker of token from a starting position through the maze to visit the space directly in front of a residence. Points are scored by visiting all residence locations on the board. U.S. Pat. No. 4,279,422, which issued to M. Shaw on July 21, 1981, discloses a board game which simulates attending college. The game utilizes a board upon which two separate paths of play are defined. One path of play is a college path which represents various academic financial occurrences which befall the student player. The other path defines a financial path which represents various financial occurrences which befall the player while working and not attending college. Each path is divided into intervals which designate various rewards or credits or detriments. Play begins on the financial path with the objective being to collect sufficient funds to attend college. Once sufficient funds to attend college have been obtained, play continues on the college path. U.S. Pat. No. 4,306,724, which issued to S. Brzezinski et al on Dec. 22, 1981, discloses a board game which utilizes a board having an inner area divided up into spaces for accommodating formation of words from letter pieces. Surrounding the inner area are a plurality of spaces defining a travel path for player pieces, which spaces include indicia referring the player's landing thereon to respective bonus, penalty and category cards which will control their next step in forming words in the central area. Play money certificates are utilized to accumulate the player's scores, based upon the letter value of words formed, and also to accommodate purchase of additional letters under certain conditions, as well as penalty payments. The throw of dice controls the movement of the player pieces while in the outer portion of the board. U.S. Pat. 4,415,160, which issued to H. Lamb on Nov. 15, 1983, discloses a medieval board game combining both fantasy and strategy game elements with chance. Each player assumes the role of a king or queen to manipulate men, gold and circumstances represented by playing cards in an effort to gain possession of an opponent's crown. The game pieces include a game board with castles represented thereon for defending each player's crown, and squares with indicia thereon which enable a player to draw a card when a game piece lands on one of the indicia. The cards represent men, gold, attack and defend moves, and circumstances such as penalties and rewards. The play is advanced by utilizing a white knight game piece and a black knight game piece for movement around the board in accordance with the throw of dice.

While the above mentioned devices are suited for their intended usage, none of these devices provide a board game which utilizes a board having a path of movement divided into squares and designating various letters, various monetary rewards and various penalties. In conjunction with a score card having recessed locations for receiving various letter tiles determined from the movement of game pieces about the game board. Inasmuch as the art is relatively crowded with respect to these various types of board games, it can be appreciated that there is a continuing need for and interest in improvements to such board games, and in this respect, the present invention addresses this need and interest.

SUMMARY OF THE INVENTION

In view of the foregoing disadvantages inherent in the known types of board games now present in the prior art, the present invention provides an improved option board game. As such, the general purpose of the present invention, which will be described subsequently in greater detail, is to provide a new and improved option board game which has all the advantages of the prior art board games and none of the disadvantages.

To attain this, a representative embodiment of the concepts of the present invention is illustrated in the drawings and makes use of a rectangular game board having a peripheral path of movement formed by a series of squares. Intersecting horizontal and vertical movement paths positioned on the interior of the game board intersect the peripheral movement path. Various squares of the movement paths are printed with individual letters of the phrase "LIFE'S LITTLE PLEASURES" and also with the letters of the word "ZONK". Various squares of the movement paths are designated with monetary rewards or penalties. Certain squares are random chance squares, with the consequence of landing on these squares determined by reference to a random consequence chart. Players move game markers around the game board according to the throw of dice.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved option board game which has all the advantages of the prior art board games and none of the disadvantages.

It is another object of the present invention to provide a new and improved option board game which may be easily and efficiently manufactured and marketed.

It is a further object of the present invention to provide a new and improved option board game which is of a durable and reliable construction.

An even further object of the present invention is to provide a new and improved option board game which is susceptible of a low cost of manufacture with regard to both materials and labor, and which accordingly is then susceptible of low prices of sale to the consuming public, thereby making such board games economically available to the buying public.

Still yet another object of the present invention is to provide a new and improved option board game which provides in the apparatuses and methods of the prior art some of the advantages thereof, while simultaneously overcoming oome of the disadvantages normally associated therewith.

Still another object of the present invention is to provide a new and improved board game which utilizes a game board having a path of movement divided into squares designated with various letters, various monetary rewards and various penalties for determining the acquisition of letters utilized to spell words of a key phrase.

Yet another object of the present invention is to provide a new and improved board game which utilizes specially designated squares in conjunction with random consequence charts to determine consequences of a game piece landing on the square in accordance with the throw of dice.

Even still another object of the present invention is to provide a new and improved board game which utilizes a race track type game board imprinted with various letters and various monetary rewards to enable players to accumulate letters to spell words of a key phrase before accumulating letters to spell a penalty word.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a diagrammatic plan view of the game board. The various segments of the game board are depicted in an enlarged view in FIGS. 2 through 7 as indicated in FIG. 1.

FIG. 7 provides an enlarged view of the lower right hand game board segment illustrated in FIG. 1.

FIG. 9 is a perspective view of an example lettered tile of the type utilized in the play of the game of the present invention.

FIG. 10 is a perspective view of an example game piece which may be utilized in the play of the game of the present invention.

FIG. 12 illustrates one of a pair of dice which are utilized in the play of the game of the present invention.

FIG. 13 illustrates a position marking chip which may be utilized in the play of the game of the present invention.

DESCRIPTION OF THE PREFERRED EMBODIMENT

Figure 8:
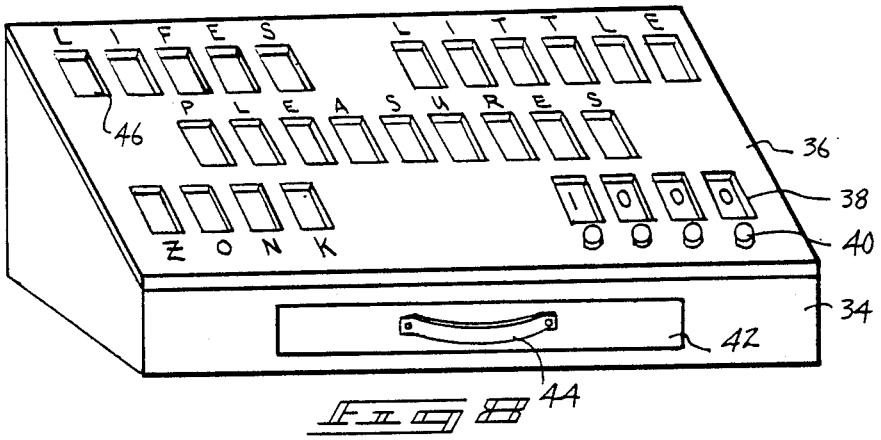
FIG. 8 is a perspective view of a score board utilized in the play of the game of the present invention.

With reference now to the drawings, and in particular to FIG. 1 thereof, a new and improved option board game embodying the principles and concepts of the present invention and generally designated by the reference numeral 10 will be described.

More specifically, it will be noted that the first embodiment 10 of the invention includes a generally rectangular game board 12 having an outer peripheral movement path 14 formed by a series of squares. Intersecting horizontal 20 and vertical 16 movement paths are formed on the interior of the game board 12. The movement paths 16 and 20 intersect at a central "START" square 18. Random consequence charts 22, 24, 26, 28, 30 and 32 are printed on the game board 12 and are utilized to determine the consequence of landing on specially designated squares in accordance with the throw of a pair of dice. To begin the game, each player starts on the central square 18 and moves a game piece in accordance with the throw of a pair of dice. Initially, a player may move in any direction from the square 18. Thereafter, a player must proceed in the initially chosen direction and may only make right turns at intersecting paths of movement. However, if a player should subsequently land on the central square 18 during the further course of play, the player again has the option of moving in any desired direction on the following turn.

Figure 2:
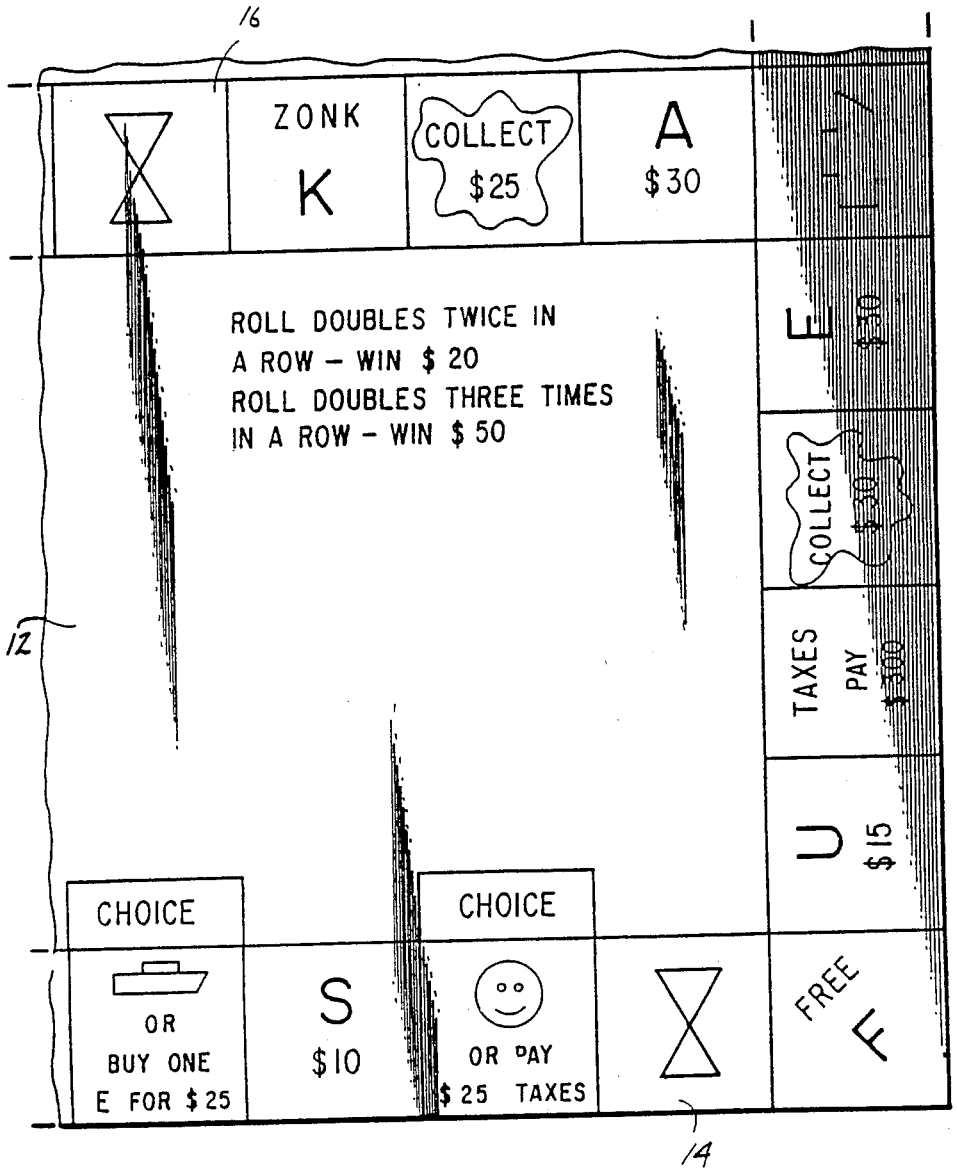
FIG. 2 provides an enlarged view of the upper right hand segment of the game board illustrated in FIG. 1.

With reference now to FIG. 2, further details of the play of the game of the present invention will be described. The squares of the movement paths are designated by various monetary rewards, by various monetary penalties and by various letters. The object of the game is to acquire sufficient letters to spell the words in the phrase "LIFE'S LITTLE PLEASURES" before acquiring the letters to spell the word "ZONK". Squares designated with a letter and a dollar amount give the player an option of purchasing the letter for the indicated amount or to ignore the offer in hopes of acquiring the letter at less cost or at a more favorable time. The smiling face symbol, the hour glass symbol, the boat symbol and the triangle refer the player to different random consequence charts to determine the consequences of landing on the particular square. The random consequence charts, to be described subsequently in greater detail, include various rewards and penalties determined in accordance with the throw of dice. Certain squares are designated as choice squares which give the player a choice of two options. For example, one choice square indicates an option between entering the random consequence chart designated by the boat symbol or purchasing one "E" for twenty five dollars. Certain other squares are penalty squares which require the player to pay a specified dollar amount. For example, the square designated "TAXES-PAY $300" requires the player to reduce his account balance by three hundred dollars. Other squares are designated as payday squares, for example, "COLLECT $30". As may now be understood, a player moves a game piece around the movement paths of the game board in accordance with the throw of dice, while endeavoring to collect the various letters and at the same time maintaining a sufficient monetary account balance.

Figure 3:
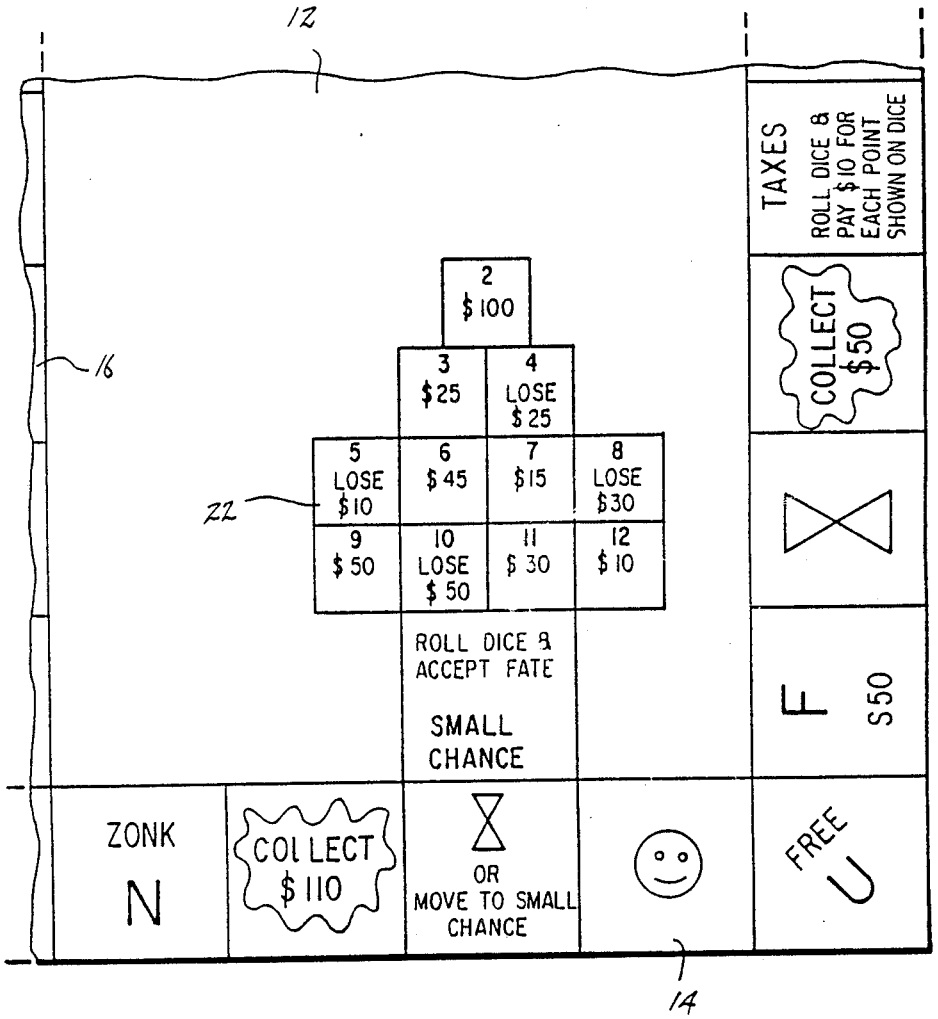
FIG. 3 provides an enlarged view of the upper left hand segment of the game board illustrated in FIG. 1.

With reference now to FIG. 3, another section of the game board is illustrated. The random consequence chart 22 is designated as "SMALL CHANCE". Certain squares on the path of movement are designated by the word "ZONK" and one of the letters in the word "ZONK". For example, the "ZONK N" square requires a player landing on the square to accept the letter "N".

Figure 4:
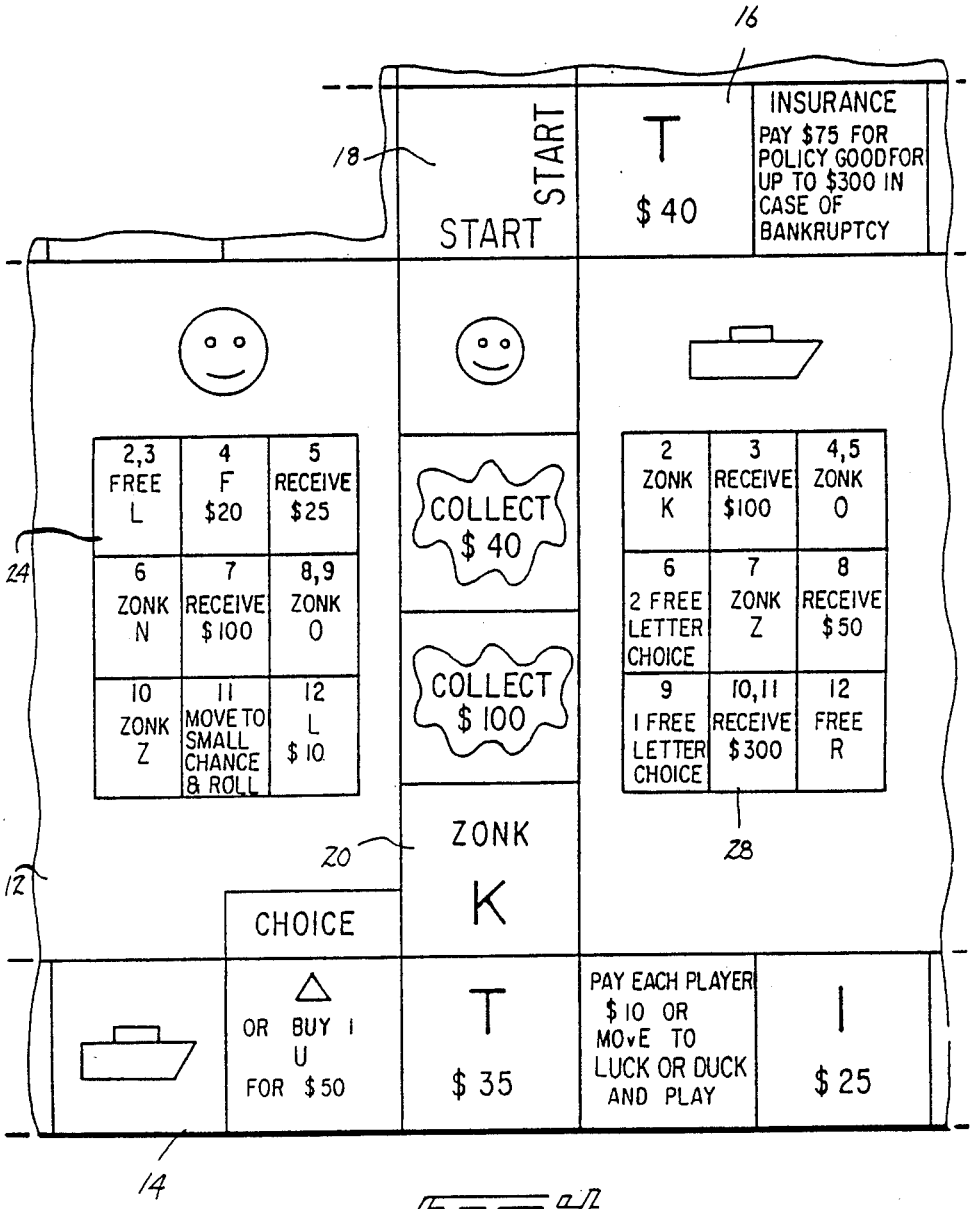
FIG. 4 provides an enlarged view of the left hand central segment of the game board illustrated in FIG. 1.

In FIG. 4, another section of the game board 12 is illustrated. The smiling face symbol random consequence chart 24 and boat symbol random consequence chart 28 are illustrated. Adjacent the upper right hand corner of FIG. 4, an "INSURANCE" square is depicted. Upon landing on this square, a player may purchase a bankruptcy insurance policy good for up to three hundred dollars in case of bankruptcy. Once purchased, the insurance can only be used in case of bankruptcy and only after all other options have been depleted. No extra money left over after bankruptcy may be received from the policy. The various designated squares offering letters for sale are color coded yellow. The squares designated as choice squares are color coded green and offer a player a choice between two options. Payday squares which award a player a designated sum of money are color coded red. Squares designated as offering a free letter are color coded orange.

Figure 5:
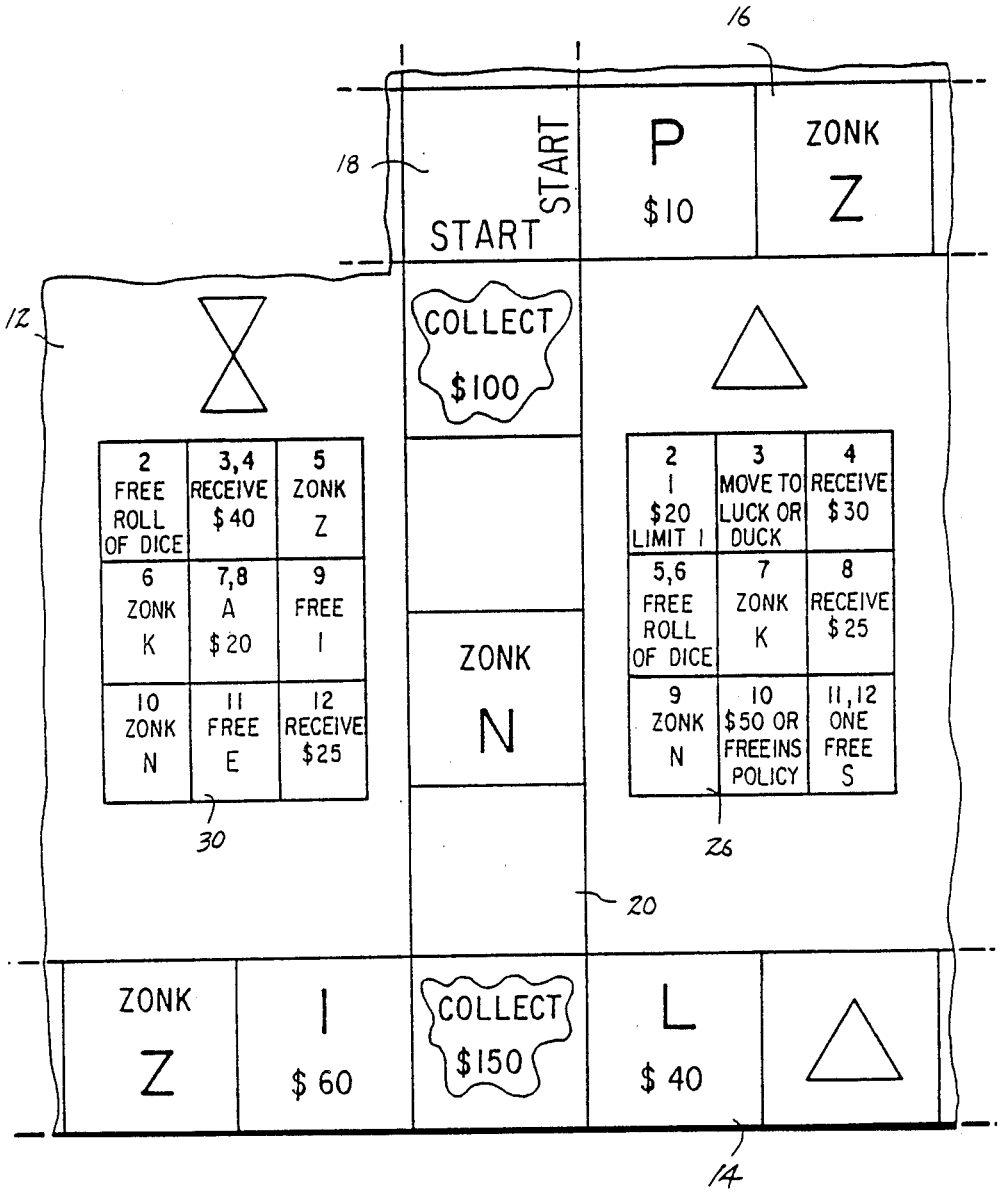
FIG. 5 provides an enlarged view of the right hand central game board segment illustrated in FIG. 1.

In FIG. 5, another section of the game board 12 is illustrated. The hour glass symbol random consequence chart 30 and triangle symbol random consequence chart 26 are depicted. The smiling face symbol, the hour glass symbol, the boat symbol and the triangle symbol respectively symbolize wealth, time, pleasure and health. A player may not win the game unless all four of these symbolic random consequence tables have been played at least once.

In FIG. 5, another section of the game board 12 is illustrated.

Figure 6:
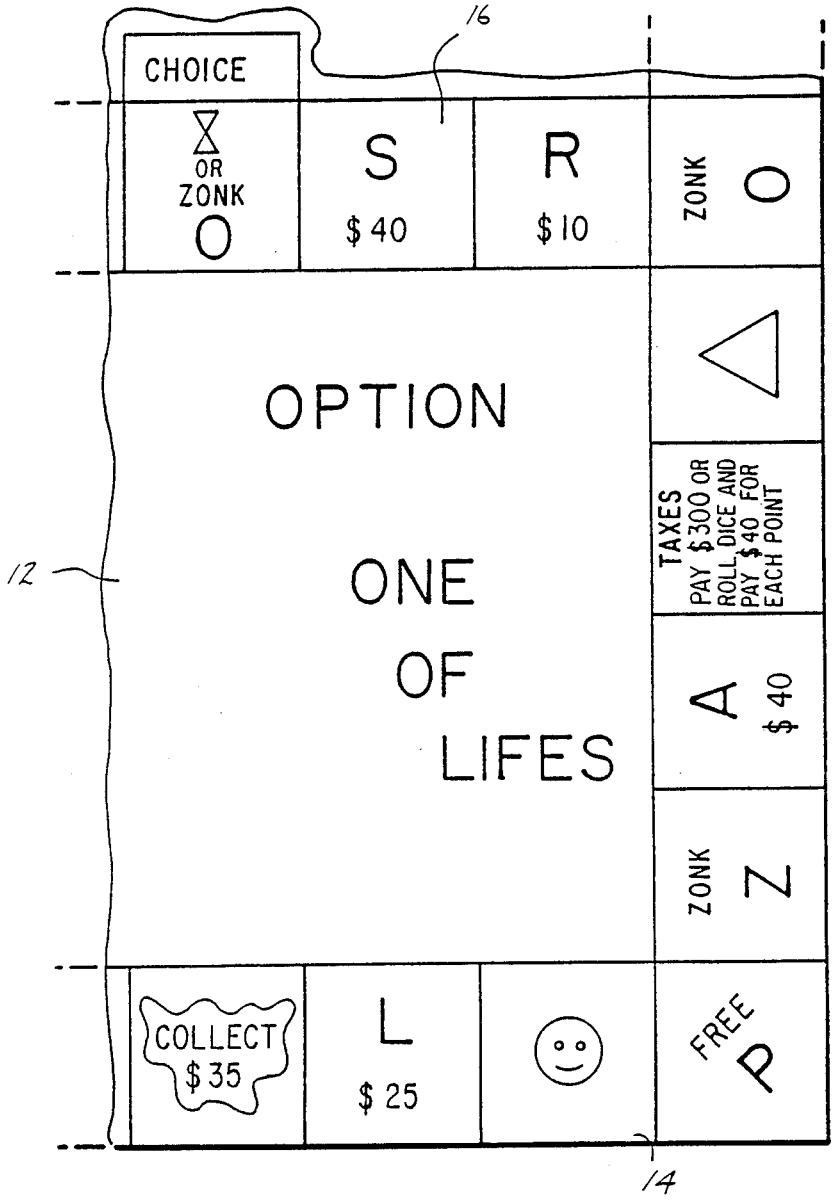
FIG. 6 provides an enlarged view of the lower left hand game board segment illustrated in FIG. 1.

In FIG. 6, an enlarged view of the lower left hand segment of the game board of FIG. 1, is illustrated.

In FIG. 7, another random consequence chart 32 is illustrated on one section of the game board 12. This random consequence chart 32 is designated as the "LUCK OR DUCK" chart.

In FIG. 8, a score board 34 is illustrated, for use in the play of the game of the present invention. The score board 34 has a plurality of recesses 46 for the reception of letter tiles. Each of the recesses 46 is designated by a letter in the phrase "LIFE'S LITTLE PLEASURES" or in the word "ZONK". A player places a letter tile in the appropriate recess 46 as these letters are acquired. The first player to spell the phrase "LIFE'S LITTLE PLEASURES" before spelling the word "ZONK" is the winner of the game. It is contemplated that the game of the present invention may be played by two or more players, with each player provided with an identical score board 34. The score board 34 also includes a mechanical digital counter 38 which includes control increment buttons 40. The digital counter 38 is utilized to keep track of a player's bank account balance. The upper surface 36 of the score board 34 is disposed at an angle to enhance visibility. A drawer 42, disposed on a front face of the score board 34, is provided for the storage of letter tiles and other game equipment. A handle 44 is provided for manipulation of the drawer 42.

In FIG. 9, a perspective view of a sample letter tile 48 is provided. Each player will be provided with a set of letter tiles consisting of four "L" tiles, four "E" tiles, one "P" tile, one "R" tile, one "N" tile, two "I" tiles, three "S" tiles, one "A" tile, one "Z" tile, one "K" tile, one "F" tile, two "T" tiles, one "U" tile and one "O" tile.

In FIG. 10, a perspective view is provided of an example game player piece 50. These pieces 50 may be color coded to distinguish between players. Alternatively, a variety of different shapes of player pieces 50 may be provided.

Figure 11:
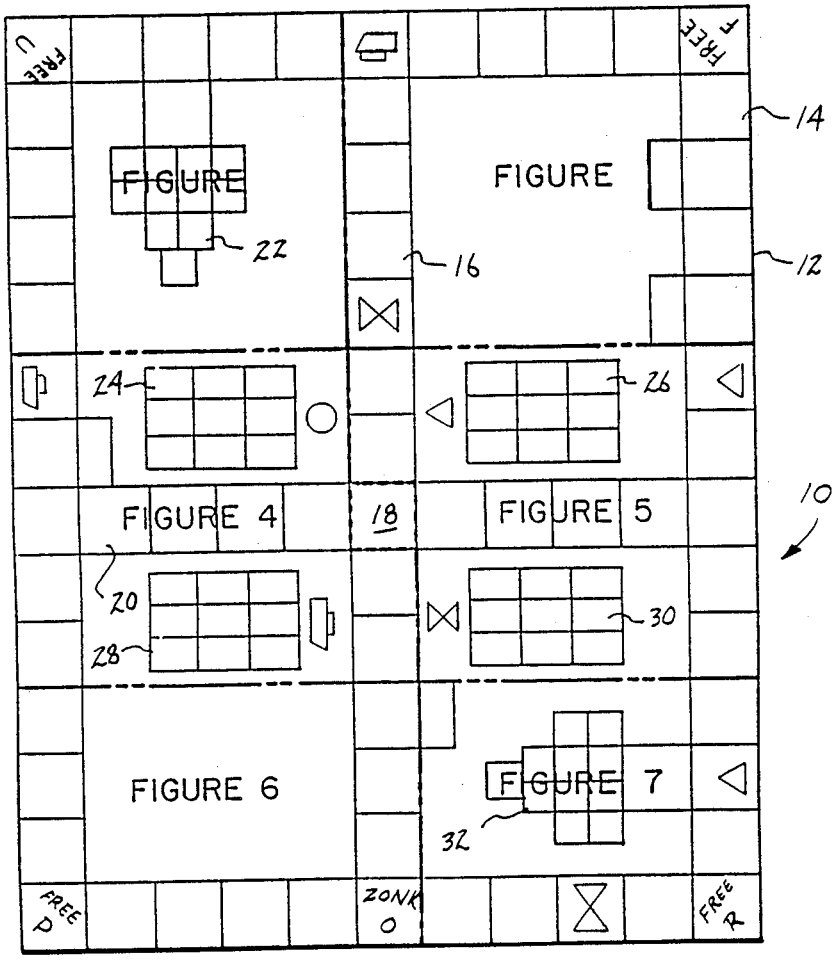
FIG. 11 is a perspective view of an example insurance policy card utilized in the play of the game of the present invention.

In FIG. 11, a perspective view is provided of an example insurance policy card 52. Four such cards are provided for use in the play of the game of the present invention. These cards are given to players when bankruptcy insurance is purchased or awarded.

In FIG. 12, a sample die 54 is illustrated. A pair of dice is utilized for determining the movement of the player pieces around the movement paths of the game board 12.

In FIG. 13, an example play marker chip 56 is illustrated. Each player is provided with such a marker chip 56 for use in determining the most advantageous option of movement on the game board 12, when a player has more than one choice of movement. The player may place the chip 56 on the game board 12, to indicate the result of a first option of movement, while considering an alternative course of play. The marker chips 56 may be color coded in different colors to distinguish between players.

Play begins in the central "START" square 18, with each player having a bank account balance of fifty dollars. Players move their game piece 50 around the movement paths 14, 16 and 20 in accordance with the throw of dice. Play continues with each player attempting to accumulate money in order to acquire the letters to spell the phrase "LIFE'S LITTLE PLEASURES". Players who land on monetary penalty squares are required to pay the stated amount or be forced into bankruptcy. In order to satisfy these obligations, a player may sell back all letters previously bought for ten dollars a piece. If a player has previously purchased insurance, this insurance may be applied toward the debt, and is good for up to three hundred dollars. No extra money left over bankruptcy may be received from the policy. Players acquiring all of the letters of the word "ZONK" or forced into bankruptcy are eliminated from the game. During the course of play, each player utilizes a score board 34 (FIG. 8) to keep track of the acquired letters and their bank account balance. An element of chance is introduced into the play of the game by the dice and through the use of the six random consequence charts 22, 24, 26, 28, 30 and 32. As may now be readily understood, the option board game of the present invention requires judgement and decision and is based on the ability of a player to think ahead.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An option board game, comprising:

a generally rectangular game board;

a peripheral first movement path on said game board, formed by a series of adjacent squares;

a vertical second movement path on an interior portion of said game board formed by a series of adjacent squares, said second movement path connecting opposite ends of said first movement path;

a horizontal third movement path on an interior portion of said frame board formed by a series of adjacent squares, said third movement path connecting opposite sides of said first movement path and intersecting said second movement path at a central "START" square;

a plurality of random consequence charts designated by an associated symbol on an interior portion of said game board, said random consequence charts having numbered boxes indicating various rewards and penalties designated by possible numerical totals obtained by rolling a pair of dice;

a first "PAYDAY" group of said series of movement path squares being designated by various monetary rewards;

a second "LETTER SALE" group of said series of movement path squares being designated by various letters of a key phrase and by an associated dollar value;

a third "FREE LETTER" group of said series of movement path squares being designated by various letters of a key phrase and by the word "FREE";

a fourth "OPTION" group of said series of movement path squares being designated by a choice of two alternative courses of play;

a fifth "SYMBOL" group of said series of movement path squares being designated by one of said random consequence chart symbols;

a sixth "PENALTY LETTER" group of said series of movement path squares designated by the key word and by one of the letters of the key word;

a plurality of player pieces for movement about said movement paths;

a pair of dice for randomly determining movement of said player pieces;

a plurality of scoreboards, each of said scoreboards having a plurality of recesses designated by the letters of the key phrase and key word;

a counter on said scoreboard for indicating a player's bank account balance;

a plurality of sets of lettered tiles, each of said sets containing all of the letters of said key phrase and said key word, said lettered tiles dimensioned to be received in said scoreboard recesses;

a plurality of position marker chips; and a plurality of "INSURANCE POLICY CARDS".

2. The option board game of claim 1, wherein said key phrase is "LIFE'S LITTLE PLEASURES" and said key word is "ZONK".

3. An option board game, comprising:

a game board;

a plurality of intersecting movement paths on said game board, each of said movement paths formed from a series of adjacent squares;

a plurality of random consequence charts on said game board designated by various symbol; each of said random consequence charts having a plurality of numbered boxes designated by possile numerical totals obtained by rolling a pair of dice;

said squares being variously designated by letters of a key phrase and an associated dollar value, by a key word and one of the letters thereof, by one of said random consequence chart symbols, by a choice of optional courses of play, by a monetary award, and by the word "FREE" and one of the letters of said key phrase;

a pair of dice;

a plurality of players pieces; and a plurality of scoreboards, each of said scoreboards having specified locations designated by the letters of said key phrase and by the letters of said key word, and numerical counter means for maintaining a player's bank account value.

4. The option board game of claim 3, wherein each of said random consequence chart numbered boxes are designated with various rewards and penalties.

* * * * *